US008141311B2

(12) United States Patent
Rodet

(10) Patent No.: US 8,141,311 B2
(45) Date of Patent: Mar. 27, 2012

(54) PANEL EQUIPPED WITH METAL FABRIC

(75) Inventor: Nicolas Rodet, La Roque d'Antheron (FR)

(73) Assignee: GKD—Gebr. Kufferath AG, Düren (DE)

( * ) Notice: Subject to any disclaimer, the term of this patent is extended or adjusted under 35 U.S.C. 154(b) by 977 days.

(21) Appl. No.: 11/665,110

(22) PCT Filed: Oct. 11, 2005

(86) PCT No.: PCT/FR2005/002506

§ 371 (c)(1),
(2), (4) Date: Jun. 20, 2007

(87) PCT Pub. No.: WO2006/040469

PCT Pub. Date: Apr. 20, 2006

(65) Prior Publication Data

US 2008/0028706 A1 Feb. 7, 2008

(30) Foreign Application Priority Data

Oct. 12, 2004 (FR) ..... 04 10740

(51) Int. Cl.

| | |
|---|---|
| ***E04C 1/00*** | (2006.01) |
| ***E04F 13/00*** | (2006.01) |
| ***E04F 15/00*** | (2006.01) |
| ***E04F 19/00*** | (2006.01) |

(52) U.S. Cl. ..... 52/309.3; 52/311.1; 156/71

(58) Field of Classification Search ..... 52/309.3, 52/311.1, 309.14, 309.1, 309.2, 309.13, 309.16, 52/309.17; 156/71, 60

See application file for complete search history.

(56) References Cited

U.S. PATENT DOCUMENTS

| | | | | |
|---|---|---|---|---|
| 3,072,520 | A * | 1/1963 | Groth | 156/213 |
| 3,679,529 | A | 7/1972 | Prusinski et al. | |
| 3,881,289 | A * | 5/1975 | Mauroner | 52/259 |
| 3,932,249 | A | 1/1976 | Jury et al. | |
| 5,972,524 | A * | 10/1999 | Childress | 428/615 |
| 5,980,665 | A * | 11/1999 | Childress | 156/92 |
| 6,027,798 | A * | 2/2000 | Childress | 428/319.3 |
| 6,124,016 | A * | 9/2000 | Weil | 428/99 |
| 6,268,049 | B1 * | 7/2001 | Childress | 428/309.9 |
| 6,436,507 | B1 * | 8/2002 | Pannell | 428/102 |
| 2007/0000199 | A1 * | 1/2007 | Siefken | 52/414 |

FOREIGN PATENT DOCUMENTS

| | | |
|---|---|---|
| DE | 93 09 189 | 9/1993 |
| DE | 93 09 189 U1 | 9/1993 |
| FR | 1 528 298 | 6/1968 |
| FR | 1 528 298 A | 6/1968 |
| GB | 13447 A | 0/1909 |

OTHER PUBLICATIONS

International Search Report, Jun. 2, 2006.

* cited by examiner

*Primary Examiner* — Mark Wendell
(74) *Attorney, Agent, or Firm* — Collard & Roe, P.C.

(57) ABSTRACT

A panel includes a metal fabric and fixers, such as two plates, assembled by glue. The metal fabric may be a screen having rod elements and a chain having wire elements. The glue may be constituted from an epoxy resin base and a modified amine hardening agent. The panel may be made by assembling two plates on a fabric by gluing. The panel may also be made by coating two plates with glue, positioning fabric on the rear plate, and positioning the front plate on the fabric and the rear plate.

9 Claims, 1 Drawing Sheet

PANEL EQUIPPED WITH METAL FABRIC

CROSS REFERENCE TO RELATED APPLICATIONS

Applicant claims priority under 35 U.S.C. §119 of French Application No. 0410740 filed Oct. 12, 2004. Applicant also claims priority under 35 U.S.C. §365 of PCT/FR2005/002506 filed Oct. 11, 2005. The international application under PCT article 21(2) was not published in English.

BACKGROUND OF THE INVENTION

1. Field of the Invention

The present invention relates to a panel comprising a metal fabric.

The field of the invention is that of decorative panels used in the building industry. These panels are often mounted on the outside of facades and serve for example to cover picture windows while allowing light to pass through. In this way, the light inside the building is less bright and the air cooler in times of strong sunshine. Such panels may also be used to partition a space occupied by people, such as an office suite.

2. Description of the Related Art

In the present case, a panel is produced from a metal fabric consisting of a screen and a chain. This fabric is assembled with a fixing means on at least one of its sides. The fixing means is furnished with a suspension device that enables the panel to be hung on an architectural element of the building.

There are disadvantages associated with panels of this kind.

Indeed, the metal fabric is made up of rigid screen elements and flexible chain elements. It is cut off of a roll and is necessarily rectangular or square in shape, since the cut is made parallel to the screen.

The elements of the screen are rods and the elements of the chain are each made up of one or more wire pairs perpendicular to the screen. A pair of wires consists of two wires that pass alternately above and below each rod so that the fabric retains its integrity. Of course, the wires fray at the cut. It is important to prevent this fraying, because this may result in the fabric falling apart.

According to a first known assembly method, the ends of the wires are welded to the rods that are positioned at the outer edges of the fabric. Otherwise, several rods are removed in a bonding area close to the cut line. Then a connecting means, for example a bar, is placed in this bonding area by inserting it in the eyebolts that are arranged at regular intervals for fixing the panel. These bolts must be arranged between elements of the chain, so that they cannot be positioned freely. Moreover, the rods located outside the bonding area must be shortened to a point level with the eyebolts. It seems that a large number of operations are required to assemble this panel:

welding the wires, passivating the welds, spacing the wires.

These operations are time-consuming and require meticulous precision on the part of the operators. Not only is the cost price expensive, the panel can only be rectangular.

According to a second known assembly method, the ends of the wires are again welded to the screen rods at the edges of the fabric. One edge of the fabric parallel to the screen is then inserted between two metal plates that serve as a fixing means. Clamping screws, which secure the joint between the fixing means and the fabric are inserted in holes created in this plates and therefore pass through the fabric to hold it in place.

The panel produced in this way may be suspended from a fixed structure by means of suspension elements that are permanently attached to one or both plates. Manufacturing a panel of this kind also takes a great deal of time and requires a high degree of accuracy on the part of the operators. In addition, the fabric cannot be positioned very precisely.

According to a third known assembly method, several rods on one edge of the fabric are removed so that the chain elements along a certain length are clear. The end of one chain element, that is to say a group of wires, that has been cleared in this way, is looped around a bar that is provided for fixing the panel. The loop that secures the join between the fabric and the bar is locked around the bar by crimping. It is possible to create these loops on all the chain elements, but this would entail a very large number of operations. It is also possible to create such loops only on a small number of chain elements, and this would necessitate welding the other elements to the last rod in the fabric. This method requires destroying the fabric along a length equivalent to that of the loops.

It should be noted that the fabrics can only be cut off parallel to the screen in all these panels.

SUMMARY OF THE INVENTION

The object of the invention is to mitigate the various drawbacks of the known methods by suggesting an improved panel.

According to the invention, a panel includes a metal fabric and a fixing means, which are assembled via a bonding means; moreover, the bonding means is glue.

The manufacture of the panel is thus so much simpler that it is conceivable that it my be carried out by generally skilled employees. All mechanical operations, such as welding, passivation, crimping, or even clamping have been dispensed with.

Furthermore, the stresses to which the panel is subjected are now distributed over the entire glued area, and not concentrated in small sites, as is the case in the related art.

It is now also possible to make diagonal or curved cuts in the fabric.

The metal fabric advantageously consists of a screen and a chain, in which the elements of the screen are rods and the elements of the chain are wires.

The glue is preferably constituted from a base and a hardening agent, the base being an epoxy resin and the hardening agent being a modified amine.

According to an improved embodiment, the fixing means includes two plates.

In this case, one of the plates, the male plate, is furnished with locating pins that are seated in the other plate, the female plate.

Conversely, the female plate is furnished with openings to accommodate the pins in the male plate.

Advantageously, at least one of the plates has a bearing surface on which the fabric rests.

In addition, at least one of the plates is furnished with holes to allow suspension elements to pass through.

One of the plates is preferably provided with a return.

If such proves necessary, the panel may include a sealing element disposed between the two plates.

A further object of the invention is a method for producing such a panel, according to which the fixing means is attached to the fabric by gluing.

When the fixing means has the form of two plates, the method advantageously includes the following steps:

a step of coating the two plates with glue;

a step of positioning fabric on one of the plates, the rear plate;

a step of positioning the other plate, the front plate, on the assembly consisting of the fabric and the rear plate.

BRIEF DESCRIPTION OF THE DRAWINGS

The present invention will now be explained in greater detail in the following description of exemplary embodiments with reference to the drawing. In the drawing.

The elements represented shown in both figures are designated with the same reference in each figure.

DETAILED DESCRIPTION OF THE PREFERRED EMBODIMENTS

Figure 1:
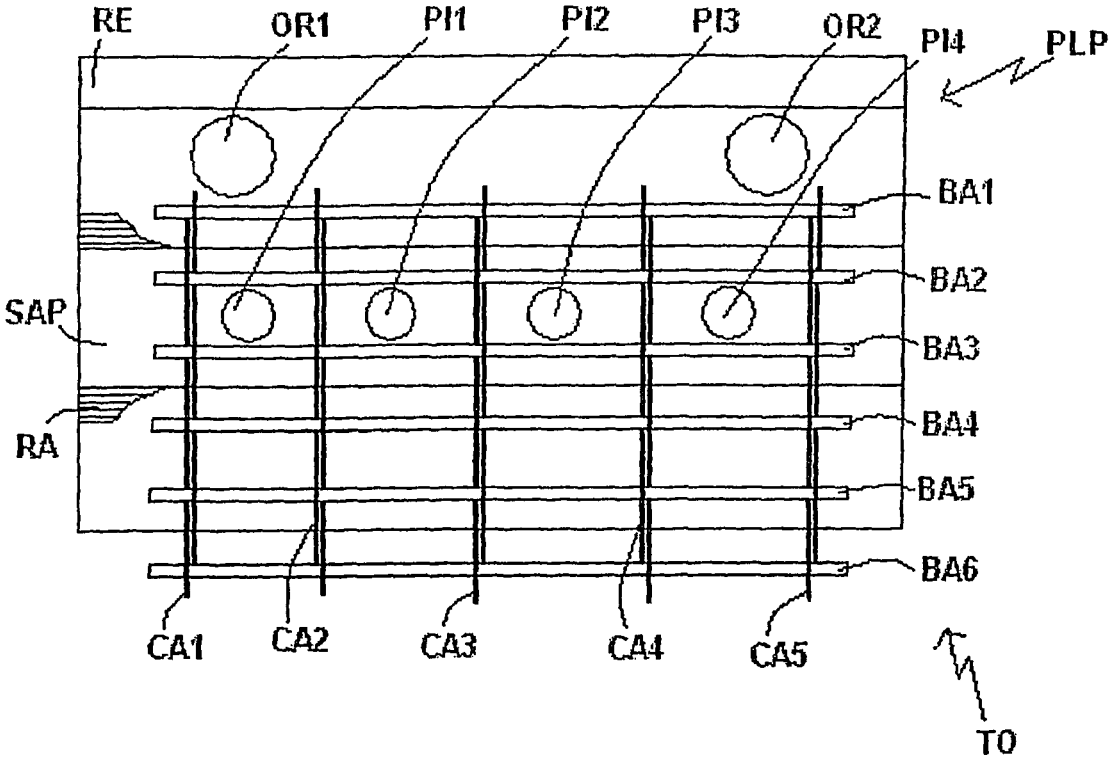
FIG. 1 shows a front view of a metal fabric supported on the rear part of a fixing means.

In FIG. 1, a metal fabric TO consists in the conventional manner of a screen and a chain. In this case, the screen is made up of parallel rods BA1, BA2, BA3, BA4, BA5, BA6. The chain is made up of chain elements, each of which includes one or more wire pairs CA1, CA2, CA3, CA4, CA5, arranged at regular intervals and perpendicularly to the rods (only one pair is shown in the figure). The wires in each pair pass above and below each rod alternately, the path of each wire being opposite to that of its pair, so that each rod is trapped between the two wires. Metal fabric TO is thus highly flexible in one of its axes, and relatively rigid in the other.

It should be noted that although the invention is implemented particularly advantageously with the fabric described above, it may also be applied to other types of fabric, particularly when the mesh is "end-on-end", when it consists entirely of wires, when it is corkscrewed or even welded.

Metal fabric TO is arranged on a rear plate PLP, which is a first component of the fixing means for this fabric. Fabric TO preferably rests on a support surface SAP which stands proud of rear plate PLP and is parallel thereto. This support surface defines a filling cavity SP between the fabric and this plate PLP.

According to a preferred feature, pins PI1, PI2, PI3, PI4 are located on support surface SAP. When fabric TO is placed on rear plate PLP, it is positioned such that pins PI1, PI2, PI3, PI4 are located between two adjacent rods, for example between second rod BA2 and third rod BA3. In order to obtain the best compromise in terms of resistance and elasticity of the fabric, it is preferable that pins PI1, PI2, PI3, PI4 be located in the middle of the spaces between two neighbouring chain elements. In this way, any bending of the rods and pulling of the wires close to the pins is minimised.

On either side of support surface SAP, the surface of rear plate PLP includes a reference mark such as a scored line or grooves RA. Only the starting outlines of these grooves are shown in the drawing for the sake of simplicity.

Before metal fabric TO is arranged on rear plate PLP, a coat of glue CO is applied to the plate in the area of grooves RA and support surface SAP.

This glue CO may be constituted from a base and a hardening agent, for example an epoxy resin and a modified amine respectively. Accordingly, the glue marketed by "3M" under the brand name "Scotch-Weld™ 7240 B/A" is a two-component structural glue that cures at room temperature. It is characterized by high-strength bonding and durability.

This type of glue provides the following advantages:

curing at room temperature, between 20 and 25° C., which may be accelerated by heating;

non-critical mixing ratio of two parts base to one part hardening agent;

mixture is viscous for easy application;

relatively long working time, about 45 minutes;

halogen-free, with flame-retardant properties;

includes 200 μm glass beads for control of glue line thickness;

high environmental resistance;

high pressure resistance and shear strength.

The area of rear plate PLP that is not covered by metal fabric TO is also furnished with holes OR1, OR2, which are designed to allow suspension elements ES to pass through. This plate is preferably also equipped with a return RE level with its upper edge, which will be explained in more detail later.

Figure 2:
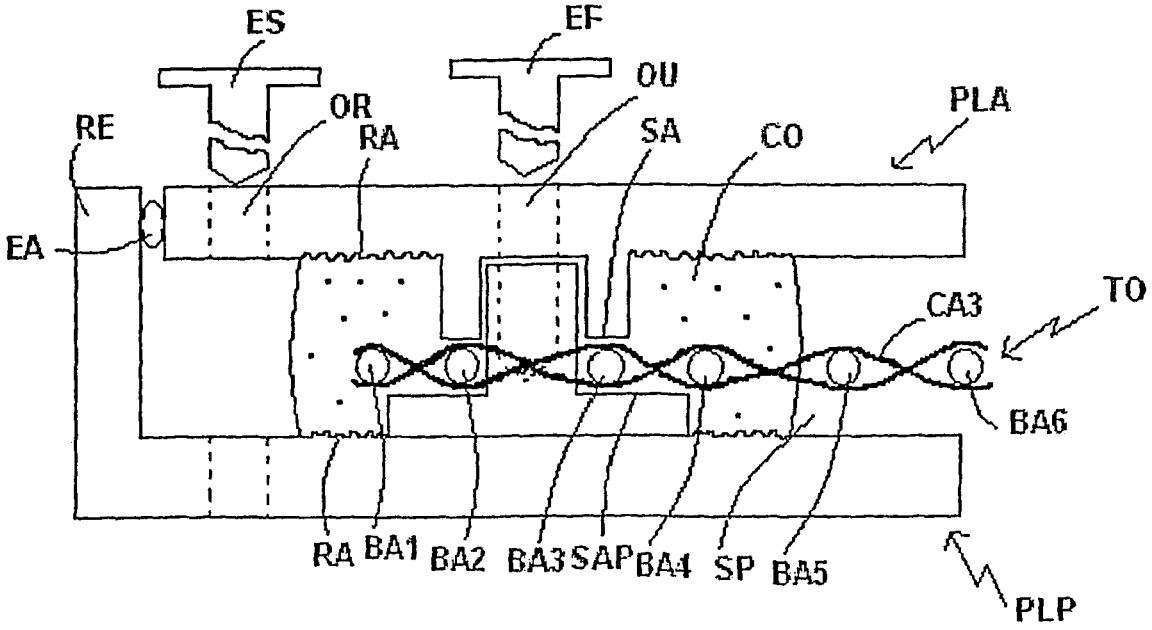
FIG. 2 shows a cross section through a metal fabric attached to the fixing means.

In FIG. 2, metal fabric TO is partly covered by a front plate PLA, the second component of the fixing means, at the level of rear plate PLP.

As before, fabric TO comes into contact with a support surface SAA, which stands proud of front plate PLA and is parallel thereto.

The respective support surfaces SAA, SAP of the two plates PLA, PLP, cooperate to allow metal fabric TO to be centered.

Front plate PLA is furnished with openings OU. When it is positioned correctly on top of rear plate PLP, pins PI1, PI2, PI3, PI4 engage in the openings OU. It is conceivable that these openings may pass through front plate PLA completely to allow fixing elements EF such as bolts to pass through and screw onto threads cut into these pins.

Front plate PLA is also furnished with holes OR. When positioned correctly, these holes are facing the corresponding holes in rear plate PLP. They enable suspension elements EF such as screws to pass through. These elements are provided for securing to a support, which is not shown.

Front plate PLA is also furnished with grooves RA opposite the grooves applied to rear plate PLP.

Before front plate PLA is placed on fabric TO, a layer of glue CO is applied over the grooves RA and the support surface SA thereof. To ensure that the glue cures evenly, it is preferable to apply the glue to both plates at about the same time.

Front plate PLA is arranged and then pressed onto rear plate PLP, which causes glue CO to penetrate fabric TO. The assembly produced in this manner is held together by fixing elements EF.

Return RE is aligned perpendicularly to the top end of rear plate PLP and close to the upper edge of front plate PLA. At this site, the space between the two plates PLA, PLP may be filled with a sealing element EA such as a silicone gasket.

Of course, it is also conceivable to place this sealing element between the two plates PLA, PLP if rear plate PLP is not furnished with a return.

The glue bead, which is thicker than the fabric, absorbs any shearing forces that might act on the edges of the plates with respect to the free portion of the fabric.

The following is a summary of the various stages of the method for producing a panel as described earlier:

coating the two plates PLA, PLP with glue CO;

placing fabric TO on rear plate PLP;

placing front plate PLA on the assembly consisting of fabric TO and rear plate PLP.

Metal fabric TO is advantageously made from stainless steel and the components of the fixing means are moulded in stainless steel, aluminum. These components may also be made from steel provided they are painted afterwards for protection.

Otherwise, it is not necessary to specify that suspension elements ES may be secured to return RE rather than to the plates.

It should also be noted that the method allows the production of panels with complex shapes which may include angular lines and curves at one or more of the ends thereof.

The invention was explained with reference to a fabric intended for decorative use. It is entirely conceivable to use the techniques described in the aforegoing for fabrics for technical applications, when it is necessary to attach such fabric to an element of some kind.

The embodiments of the invention described above were selected with a view to their specific character. However, it would not be possible to list all the possible embodiment variations that fall within the scope of this invention. In particular, any method described may be replaced by an equivalent method without exceeding the scope of the present invention.

The invention claimed is:

1. A panel comprising a metal fabric and a fixing means that are assembled by bonding means, wherein the bonding means is glue and wherein the fixing means includes first and second plates, at least the first plate being a male plate furnished with pins penetrating the glue and engaging with the second plate, each pin having a length and a tip, the second plate being a female plate furnished with openings cooperating with the pins on the male plate, wherein the pins of the male first plate are seated in the female second plate, so that the lengths of the pins are located entirely between the first and second plates and the pins are accommodated in the openings of the female second plate via the tips of the pins, wherein the metal fabric comprises a screen and a chain, the elements of the screen being rods, and the elements of the chain being wires.

2. The panel as recited in claim 1, wherein the glue is constituted from a base and a hardening agent, the base being an epoxy resin and the hardening agent being a modified amine.

3. The panel as recited in claim 1, wherein at least one of the first and second plates is furnished with a reference mark.

4. The panel as recited in claim 1, wherein at least one of the first and second plates has a support surface on which the fabric is supported.

5. The panel as recited in claim 1, further comprising a sealing element located between the first and second plates.

6. A method for producing a panel, the method comprising a step of assembling fixing means on a fabric by gluing with glue;

wherein the fabric is metal and comprises a screen and a chain, the elements of the screen being rods, and the elements of the chain being wires;

wherein the fixing means includes first and second plates, the first plate being a male plate furnished with pins and engaging with the second plate, each pin having a length and a tip, the second plate being a female plate furnished with openings cooperating with the pins of the male plate;

wherein the pins of the male plate are seated in the female plate so that the lengths of the pins are located entirely between the first and second plates and the pins are accommodated in the openings of the female plate via the tips of the pins; and wherein the pins penetrate the glue.

7. A method for producing a panel, the method comprising steps of:

coating a first plate with glue, the first plate being a male plate furnished with pins;

coating a second plate with glue, the second plate being a female plate furnished with openings;

positioning fabric on a rear plate of the first and second plates; and positioning a front plate of the first and second plates on the fabric and the rear plate such that the openings of the female plate cooperate with the pins of the male plate, such that the pins of the male plate are seated in the female second plate so that the lengths of the pins are located entirely between the first and second plates, and such that the pins are accommodated in the openings of the female plate via the tips of the pins;

wherein the fabric is metal and comprises a screen and a chain, the elements of the screen being rods, and the elements of the chain being wires; and wherein the pins penetrate the glue.

8. A panel comprising a metal fabric and a fixing means that are assembled by bonding means, wherein the bonding means is glue and wherein the fixing means includes first and second plates, at least the first plate being a male plate furnished with pins penetrating the glue and engaging with the second plate, each pin having a length and a tip, the second plate being a female plate furnished with openings cooperating with the pins on the male plate, wherein the pins of the male first plate are seated in the female second plate, so that the lengths of the pins are located entirely between the first and second plates and the pins are accommodated in the openings of the female second plate via the tips of the pins, wherein at least one of the first and second plates is furnished with holes provided to allow suspension elements to pass through.

9. A panel comprising a metal fabric and a fixing means that are assembled by bonding means, wherein the bonding means is glue and wherein the fixing means includes first and second plates, at least the first plate being a male plate furnished with pins penetrating the glue and engaging with the second plate, each pin having a length and a tip, the second plate being a female plate furnished with openings cooperating with the pins on the male plate, wherein the pins of the male first plate are seated in the female second plate, so that the lengths of the pins are located entirely between the first and second plates and the pins are accommodated in the openings of the female second plate via the tips of the pins, wherein one of the first and second plates has a return.

* * * * *